US009853403B1

(12) United States Patent
Chen

(10) Patent No.: US 9,853,403 B1
(45) Date of Patent: Dec. 26, 2017

(54) BOARD TO BOARD CONNECTOR ASSEMBLY, FEMALE CONNECTOR AND MALE CONNECTOR

(71) Applicant: OUPIIN ELECTRONIC (KUNSHAN) CO., LTD., Kunshan (CN)

(72) Inventor: Hsin Chih Chen, Kunshan (CN)

(73) Assignee: OUPIIN ELECTRONIC (KUNSHAN) CO., LTD., Kunshan (CN)

( * ) Notice: Subject to any disclaimer, the term of this patent is extended or adjusted under 35 U.S.C. 154(b) by 0 days.

(21) Appl. No.: 15/462,856

(22) Filed: Mar. 19, 2017

(30) Foreign Application Priority Data

Jul. 28, 2016 (CN) ..... 2016 1 0603622

(51) Int. Cl.

| | |
|---|---|
| ***H01R 24/60*** | (2011.01) |
| ***H01R 12/71*** | (2011.01) |
| ***H01R 12/00*** | (2006.01) |
| *H01R 107/00* | (2006.01) |

(52) U.S. Cl.
CPC ..... *H01R 24/60* (2013.01); *H01R 9/096* (2013.01); *H01R 12/716* (2013.01); *H01R 2107/00* (2013.01)

(58) Field of Classification Search
CPC ..... H01R 9/096; H01R 12/52; H01R 12/716; H01R 24/60; H01R 2107/00
USPC ..... 439/676, 65, 74
See application file for complete search history.

(56) References Cited

U.S. PATENT DOCUMENTS

| | | | | |
|---|---|---|---|---|
| 5,546,281 A * | 8/1996 | Poplawski | G02B 6/4284 | 361/752 |
| 5,882,212 A * | 3/1999 | McHugh | H01R 12/716 | 439/660 |
| 5,915,976 A * | 6/1999 | McHugh | H01R 13/65802 | 439/108 |
| 5,921,787 A * | 7/1999 | Pope | H01R 12/85 | 439/660 |
| 5,975,916 A * | 11/1999 | Okura | H01R 12/716 | 439/660 |
| 6,036,504 A * | 3/2000 | McHugh | H01R 12/52 | 439/660 |
| 6,257,900 B1 * | 7/2001 | Huang | H01R 12/716 | 439/74 |
| 6,702,590 B2 * | 3/2004 | Zaderej | H01R 23/688 | 439/607.05 |
| 6,793,506 B1 * | 9/2004 | Hirata | H01R 12/716 | 439/65 |

(Continued)

*Primary Examiner* — Tulsidas C Patel
*Assistant Examiner* — Travis Chambers
(74) *Attorney, Agent, or Firm* — Mark M. Friedman

(57) ABSTRACT

A board to board connector assembly is disclosed in this invention, which includes a female connector and a male connector. Each female terminal has an elastic engaging section and a first protrusion located on the top of the elastic engaging section. Each male terminal has an elastic arm and a second protrusion located on the top of the elastic arm. When the female connector is matched with the male connector, the second protrusion passes the first protrusion, and a bottom surface of the second protrusion and a bottom surface of the first protrusion are engaged with each other and together form a holding state. The board to board connector assembly can ensure the reliable connection of the two connectors by the engagement of the female and male terminals.

9 Claims, 9 Drawing Sheets

(56) References Cited

U.S. PATENT DOCUMENTS 6,827,588 B1 * 12/2004 Huang ..... H01R 12/716 439/74
7,118,388 B2 * 10/2006 Midorikawa ..... H01R 12/716 439/74
7,195,495 B2 * 3/2007 Takano ..... H01R 12/716 439/660
7,232,317 B2 * 6/2007 Ookura ..... H01R 13/506 439/660
7,575,441 B1 * 8/2009 Huang ..... H01R 12/716 439/74
7,635,274 B2 * 12/2009 Fukazawa ..... H01R 12/716 439/247
7,748,994 B1 * 7/2010 Peng ..... H01R 13/6315 439/660
7,862,345 B2 * 1/2011 Fukazawa ..... H01R 12/716 439/74
7,950,929 B2 * 5/2011 Yu ..... H01R 12/716 439/660
8,277,241 B2 * 10/2012 Horchler ..... H01R 13/6271 439/295
8,858,239 B2 * 10/2014 Little ..... H01R 13/28 439/74
8,888,506 B2 * 11/2014 Nishimura ..... H01R 12/7082 439/74
8,979,551 B2 * 3/2015 Mongold ..... H01R 12/73 439/74
2004/0063344 A1 * 4/2004 Shin ..... H01R 12/716 439/74
2004/0198077 A1 * 10/2004 Zaderej ..... H01R 23/688 439/74
2004/0253848 A1 * 12/2004 Huang ..... H01R 12/716 439/74
2011/0045679 A1 * 2/2011 Yu ..... H01R 12/716 439/66
2014/0148022 A1 * 5/2014 Mongold ..... H01R 12/73 439/74

* cited by examiner

BOARD TO BOARD CONNECTOR ASSEMBLY, FEMALE CONNECTOR AND MALE CONNECTOR

BACKGROUND OF THE INVENTION

1. Field of the Invention

The present invention relates to a connector technology, and more particularly to a board to board connector assembly, a female connector and a male connector, all of which have the reliable electrical connection performance.

2. Description of the Prior Art

A board to board connector assembly has the highest transmission capacity in all current connector products, and is widely applied in power systems, communications networks, office equipment, home appliances and other industries. The board to board connector assembly is used to connect two parallel circuit boards, and includes a female connector and a male connector. The female connector and the male connector are respectively disposed on a mother circuit board and a daughter circuit board. When the female connector and the male connector are engaged with each other, the two circuit boards are connected together and are parallel to each other.

The prior male connector usually employs a straight rigid terminal, and the female connector employs a bent elastic terminal. The two connectors are electrically connected by an electrical contact of the rigid terminal and the elastic terminal. However, the connection mode still has some security risks, for example, the connection between terminals is not reliable, the contact is not stable, more serious is that two connectors may be separated from each other.

Hence, it is necessary to provide a new board to board connector assembly, male and female terminals of which can be reliably engaged with each other to produce the stable electrical contact.

BRIEF SUMMARY OF THE INVENTION

A first object of the present invention is to provide a board to board connector assembly, male and female terminals of which can be reliably engaged with each other to produce the stable electrical contact.

A second object of the present invention is to provide a female connector, a female terminal of which has an elastic mating structure for being reliably engaged with a male terminal to produce the stable electrical contact.

A third object of the present invention is to provide a male connector, a male terminal of which has an elastic mating structure for being reliably engaged with a female terminal to produce the stable electrical contact.

Other objects and advantages of the present invention may be further understood from the technical features disclosed by the present invention.

To achieve the aforementioned object or other objects of the present invention, the present invention adopts the following technical solution.

The present invention provides a board to board connector assembly, comprising a female connector and a male connector. The female connector includes a female housing and two rows of symmetrically arranged female terminals. The female housing has a bottom wall, two longitudinal walls standing on the bottom wall and being parallel to each other, two transverse walls standing on the bottom wall and being parallel to each other, a receiving cavity defined by the two longitudinal walls and the two transverse walls, an opening formed above the receiving cavity, and two rows of female terminal-receiving passages being symmetrically formed on the inside of the longitudinal walls and passing through the opening and the bottom wall. Each female terminal has a horizontal section, an elastic engaging section being connected with one end of the horizontal section and extending upward, and a tail section being connected with the other end of the horizontal section and horizontally extending away from the side of the horizontal section. The elastic engaging section has a first protrusion, which is located on the top of the elastic engaging section and protrudes toward the direction opposite to the tail section. The elastic engaging section is received in the corresponding female terminal-receiving passage, the first protrusion is partly exposed in the receiving cavity, and the tail section extends out of the female housing. The male connector includes a male housing and two rows of symmetrically arranged male terminals. The male housing includes a base, a tongue plate standing on the base, and two rows of male terminal-receiving passages being symmetrically formed on the tongue plate. Each male terminal has a vertical plate, an elastic arm standing on the top of the vertical plate, and a tail portion located on the bottom of the vertical plate and horizontally extending away from the side of the vertical plate. The elastic arm has a second protrusion, which is located on the top of the elastic arm and protrudes toward the direction same as the tail portion. The elastic arm is located in the corresponding male terminal-receiving passage. The second protrusion is partly exposed outside the male terminal-receiving passage for being engaged with the corresponding female terminal. And the tail portion horizontally extends out of the tongue plate. When the male connector and the female connector are engaged with each other, the tongue plate of the male connector is inserted into the receiving cavity from the opening of the female connector, the second protrusion passes the first protrusion, and a bottom surface of the second protrusion contacts with a bottom surface of the first protrusion to form a holding state.

In one embodiment, the top of the first protrusion is a slope, and the bottom surface of the first protrusion is perpendicular to the elastic engaging section; and the top of the second protrusion is an inclined surface, and the bottom surface of the second protrusion is perpendicular to the elastic arm.

In one embodiment, the female terminal further has a vertical retaining section being located between the tail section and the elastic engaging section, being connected with the horizontal section and extending upward. The length of the elastic engaging section is greater than that of the vertical retaining section. The elastic engaging section and the vertical retaining section are independent and separate. The elastic engaging section is not completely perpendicular to the horizontal section. The female housing further has two rows of symmetrically arranged female terminal-retaining holes formed on the bottom wall and respectively located on two sides of the two longitudinal walls, and each female terminal-retaining hole is communicated with one corresponding female terminal-receiving passage on the bottom of the bottom wall. Wherein the vertical retaining section is inserted into and fixed into the corresponding female terminal-retaining hole.

In one embodiment, the female terminal further has an arc section to connect the horizontal section and the elastic engaging section.

In one embodiment, the male terminal further has a retaining arm standing on the top of the vertical plate and located on the side of the elastic arm. The length of the elastic arm is greater than that of the retaining arm, and the elastic arm and the retaining arm are independent and separate. And the male housing further includes two rows of male terminal-retaining holes being symmetrically formed on the tongue plate and located on the inside of the corresponding male terminal-receiving passages. Each male terminal-retaining hole is communicated with the corresponding male terminal-receiving passage under the tongue plate. The retaining arm is inserted into and fixed into the corresponding male terminal-retaining hole.

In one embodiment, the elastic arm further has an upright section connected to the top of the vertical plate, and a tilted section extending upward from the top of the upright section and being tilted to the retaining arm; the second protrusion is formed on the top of the tilted section, and the bottom surface of the second protrusion is perpendicular to the tilted section.

In one embodiment, the tongue plate has a T-shaped section, the bottoms of these male terminal-receiving passages pass through the bottom of the tongue plate, and the tops of these male terminal-receiving passages do not pass through the top of the tongue plate.

In one embodiment, the male housing and the female housing are elongated. The two longitudinal walls and the two transverse walls of the female housing are perpendicular to each other; the longitudinal wall is longer than the transverse wall. The opening defined by the two longitudinal walls and the two transverse walls is rectangular. The base of the male housing consists of two support blocks respectively located on two sides of the tongue plate, and each support block disposes a support post on the bottom thereof.

The present invention further provides a female connector, comprising a female housing and two rows of symmetrically arranged female terminals. The female housing is elongated and has a bottom wall, two longitudinal walls standing on the bottom wall and being parallel to each other, two transverse walls standing on the bottom wall and being parallel to each other, a receiving cavity defined by the two longitudinal walls and the two transverse walls, an opening formed above the receiving cavity, two rows of female terminal-receiving passages being symmetrically formed on the inside of the longitudinal walls and passing through the opening and the bottom wall, and two rows of symmetrically arranged female terminal-retaining holes formed on the bottom wall and respectively located on two sides of the two longitudinal walls. Wherein each female terminal-retaining hole is communicated with one corresponding female terminal-receiving passage on the bottom of the bottom wall. Each female terminal has a horizontal section, an elastic engaging section being connected with one end of the horizontal section and extending upward, a tail section being connected with the other end of the horizontal section and horizontally extending away from the side of the horizontal section, and a vertical retaining section being located between the tail section and the elastic engaging section, being connected with the horizontal section and extending upward. The elastic engaging section has a first protrusion, which is located on the top of the elastic engaging section and protrudes toward the direction opposite to the tail section; the top of the first protrusion being a slope. Wherein the elastic engaging section is received in the corresponding female terminal-receiving passage, the first protrusion is partly exposed in the receiving cavity, the tail section extends out of the female housing, and the vertical retaining section is inserted into and fixed into the corresponding female terminal-retaining hole.

The present invention further provides a male connector, comprising a male housing and two rows of symmetrically arranged male terminals. The male housing includes a base, a tongue plate standing on the base, two rows of male terminal-receiving passages being symmetrically formed on the tongue plate, and two rows of male terminal-retaining holes being symmetrically formed on the tongue plate and located on the inside of the corresponding male terminal-receiving passages. The tongue plate has a T-shaped section. Each male terminal-retaining hole is communicated with the corresponding male terminal-receiving passage under the tongue plate. Each male terminal has a vertical plate, an elastic arm standing on the top of the vertical plate, and a tail portion located on the bottom of the vertical plate and horizontally extending away from the side of the vertical plate. The elastic arm has an upright section connected to the top of the vertical plate, a tilted section extends upward from the top of the upright section and is tilted to the retaining arm, and a second protrusion, which is located on the top of the tilted section and protrudes toward the direction same as the tail portion; the top of the second protrusion is an inclined surface. Wherein the elastic arm is located in the corresponding male terminal-receiving passage, the second protrusion is partly exposed outside the male terminal-receiving passage for being engaged with a corresponding female terminal, the retaining arm is inserted into and fixed into the corresponding male terminal-retaining hole, and the tail portion horizontally extends out of the tongue plate.

In comparison with the prior art, the board to board connector assembly of the present invention provides the male terminal and the female terminal, both of which dispose elastic mating structures for making the both be engaged with each other and have the reliable connection and the stable electrical contact. Furthermore, the electrical connection between the male connector and female connector is reliable.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" etc., are only used with reference to the orientation of the accompanying drawings. Therefore, the used directional terms are intended to illustrate, but not to limit, the present invention.

Figure 1:
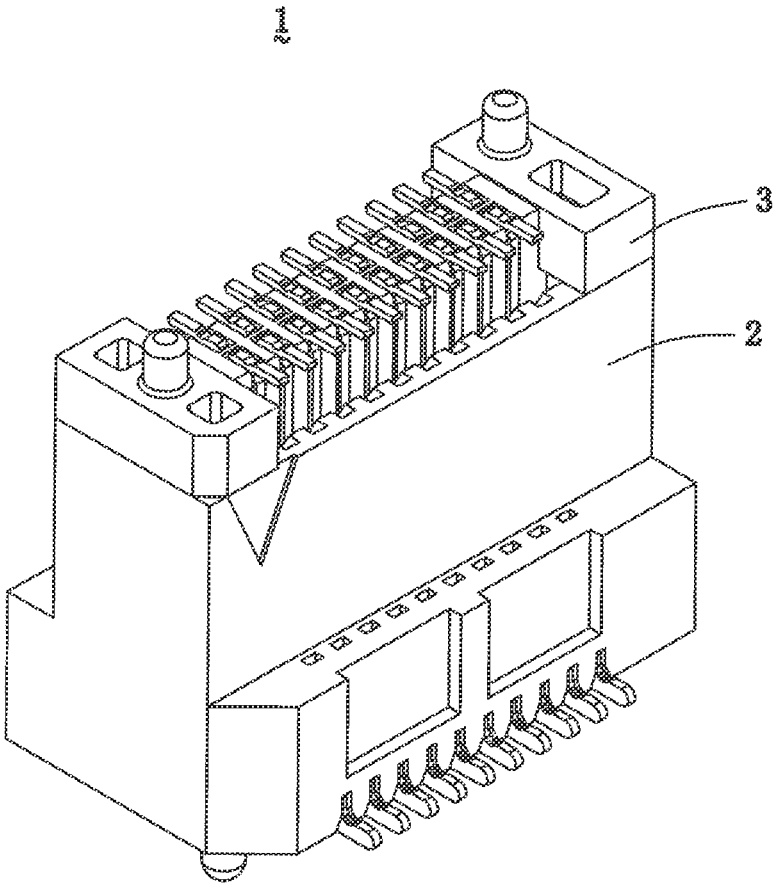
FIG. 1 is a perspective view of a board to board connector assembly of the present invention after being combined.
Figure 2:
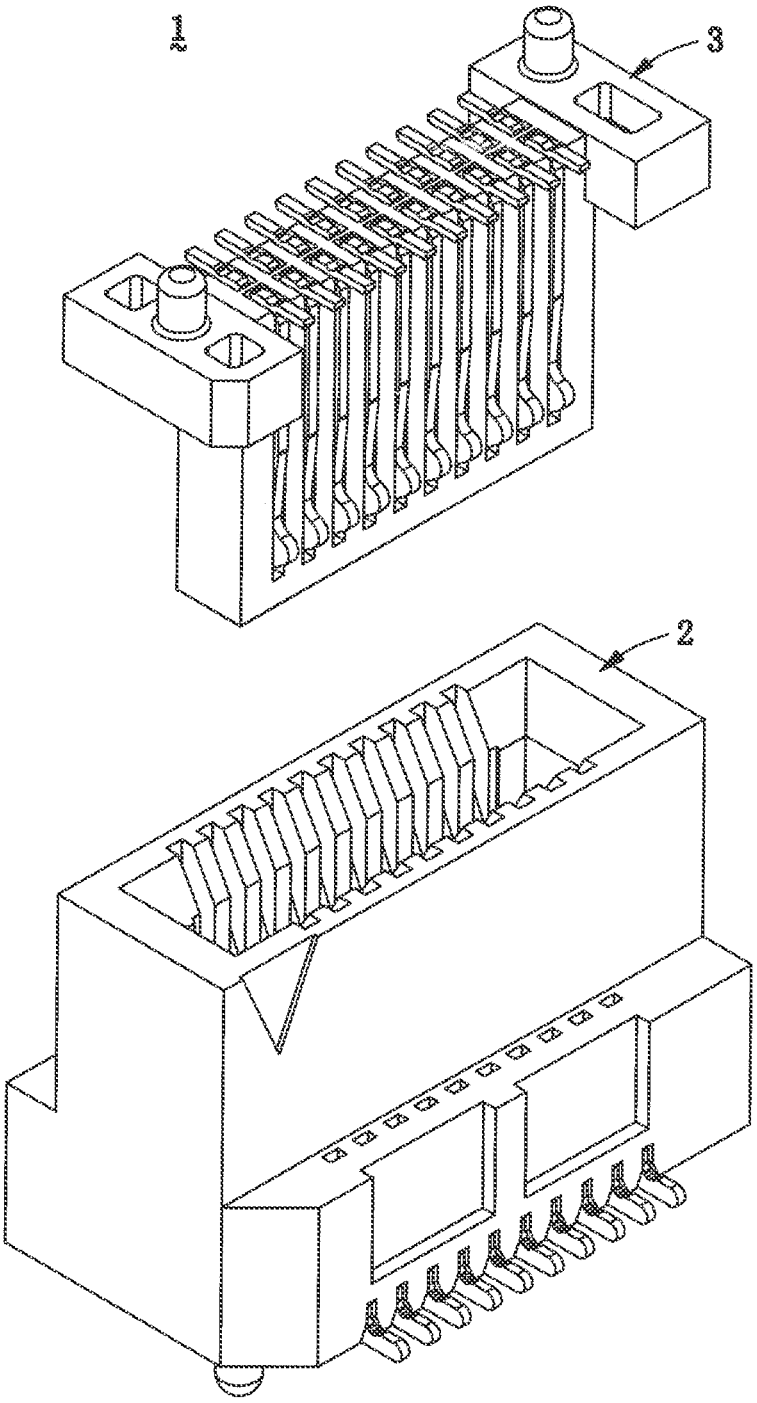
FIG. 2 is a perspective view of the board to board connector assembly after being separated.
Figure 3:
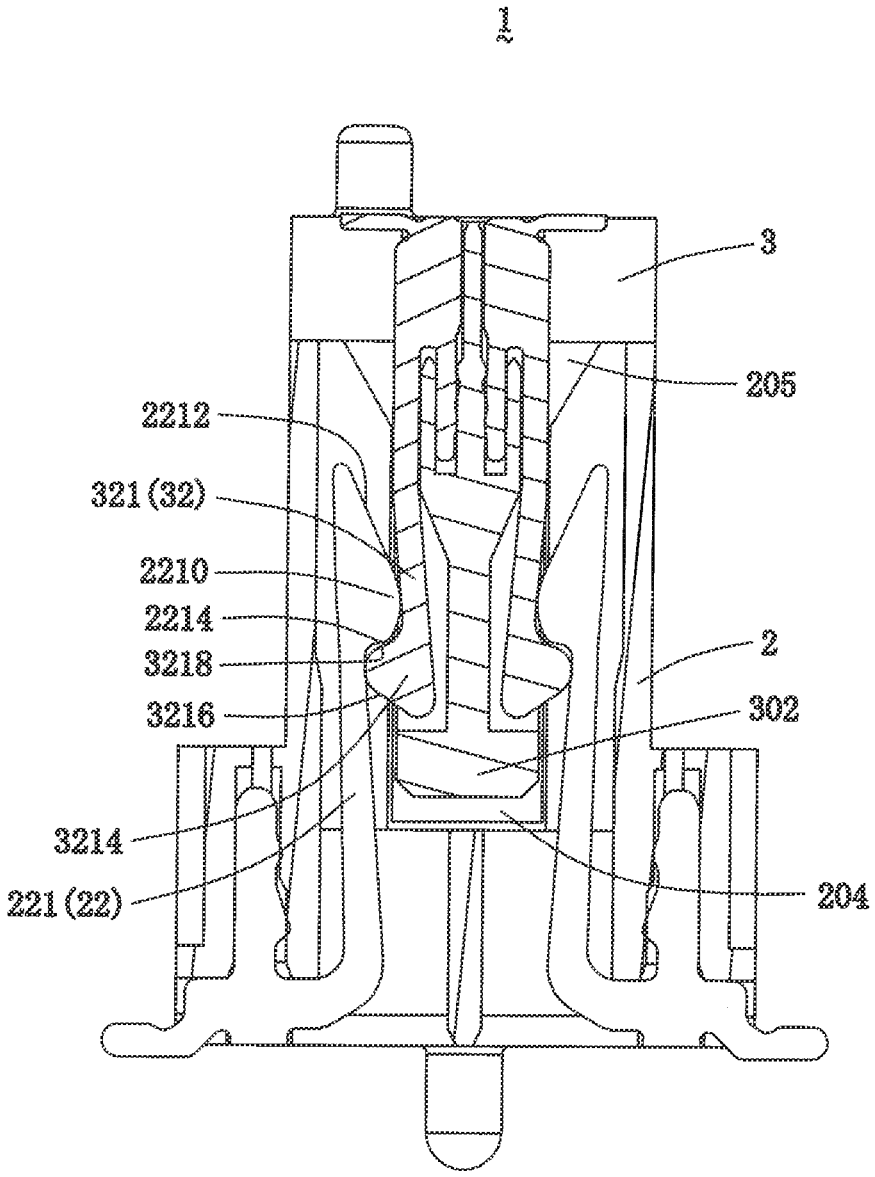
FIG. 3 is a section view of the board to board connector assembly after being combined.

Please refer to FIGS. 1, 2 and 3, a board to board connector assembly 1 of the present invention comprises a female connector 2 and a male connector 3, which can be combined together to form the reliable electrical connection.

Figure 4:
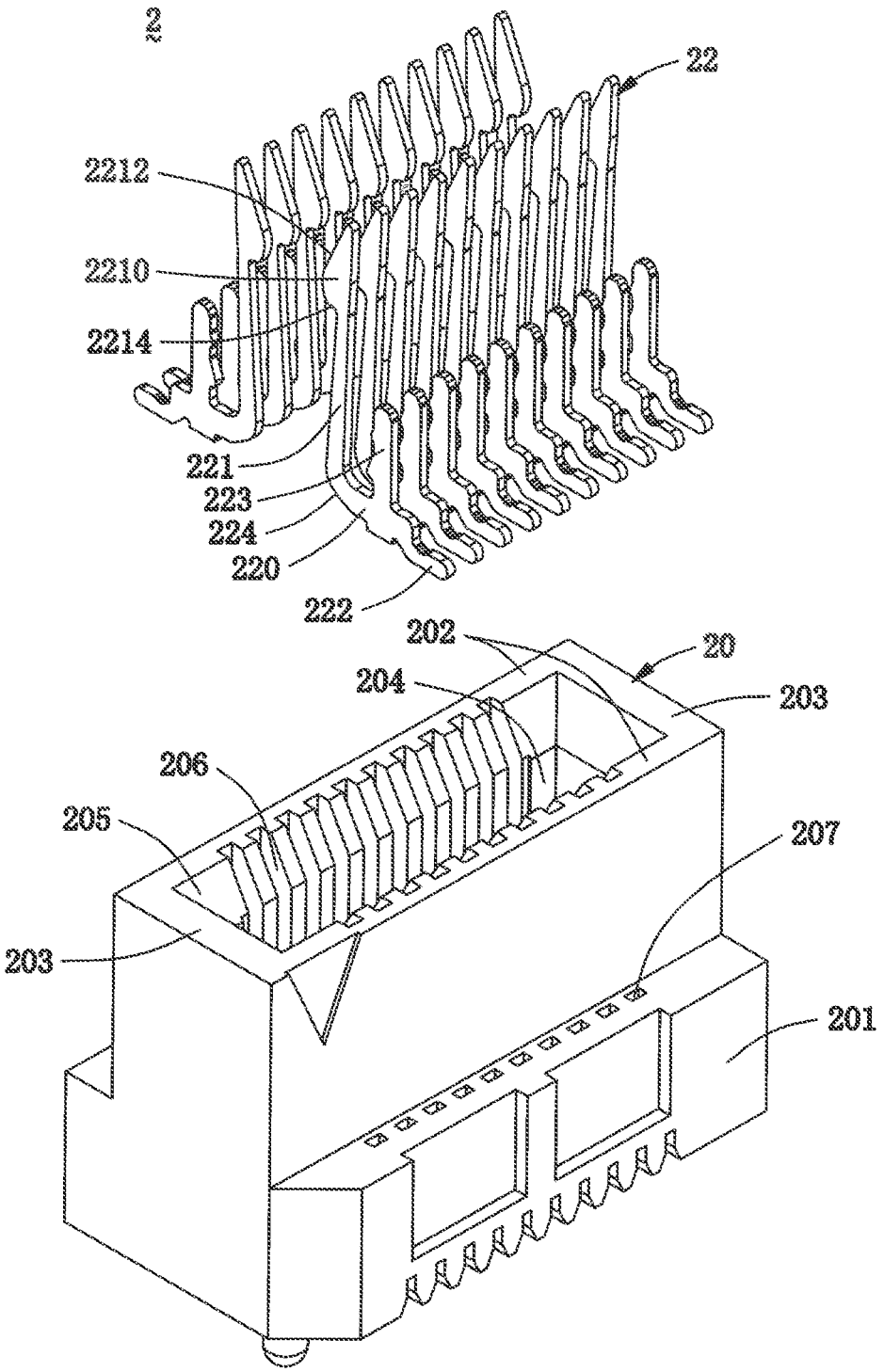
FIG. 4 is an exploded view of a female connector of the present invention.
Figure 5:
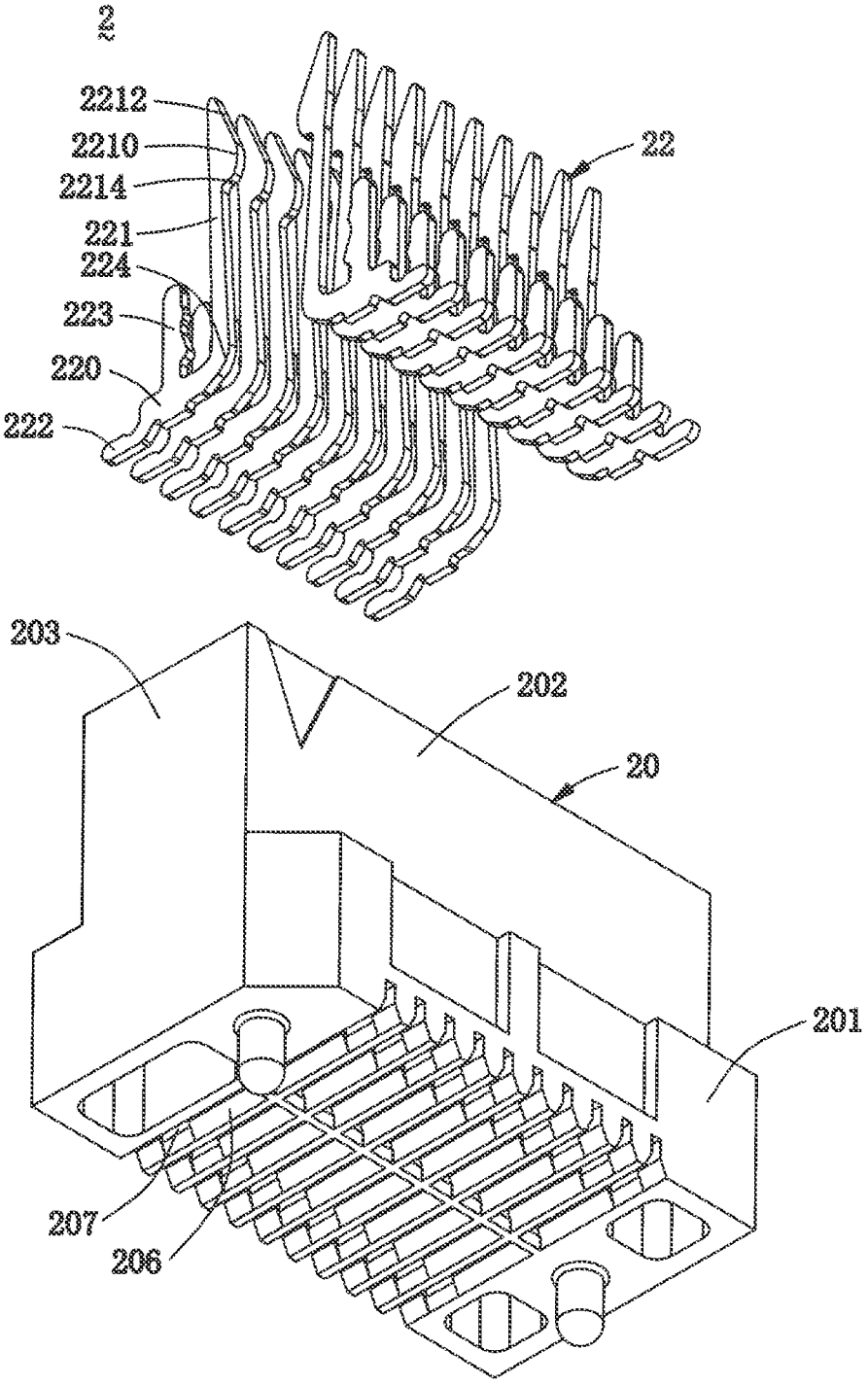
FIG. 5 is an exploded view of the female connector along another direction.
Figure 6:
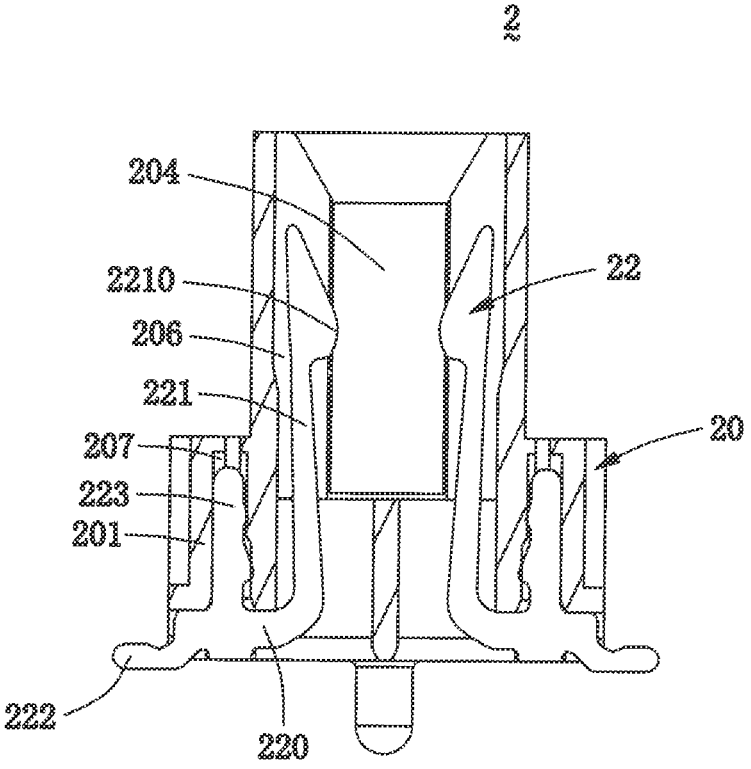
FIG. 6 is a section view of the female connector.

Please refer to FIGS. 4, 5 and 6, the female connector 2 includes a female housing 20 and two rows of symmetrically arranged female terminals 22.

Referring to FIGS. 4 and 5, the female housing 20 is elongated and includes a bottom wall 201, two longitudinal walls 202 standing on the bottom wall 201 and being parallel to each other, two transverse walls 203 standing on the bottom wall 201 and being parallel to each other, a receiving cavity 204 defined by the two longitudinal walls 202 and the two transverse walls 203, an opening 205 formed above the receiving cavity 204, two rows of female terminal-receiving passages 206 being symmetrically formed on the inside of the longitudinal walls 202 and passing through the opening 205 and the bottom wall 201, and two rows of female terminal-retaining holes 207 symmetrically formed on the bottom wall 201 and respectively located on two sides of the two longitudinal walls 202.

Referring to FIGS. 4 and 5, the bottom wall 201 has a certain thickness. Please refer to FIG. 6, each female terminal-retaining hole 207 is communicated with one corresponding female terminal-receiving passage 206 on the bottom of the bottom wall 201, so that the corresponding female terminal 22 can be inserted into the female terminal-retaining hole 207 and the female terminal-receiving passage 206. The two longitudinal walls 202 are perpendicular to the two transverse walls 203, and the longitudinal wall 202 is longer than the transverse wall 203. The opening 205 defined by the two longitudinal walls 202 and the two transverse walls 203 is rectangular. Each female terminal-receiving passage 206 extends from the top of the female housing 20 onto the bottom of the female housing 20.

Referring to FIGS. 4 and 5, each female terminal 22 has a horizontal section 220, an elastic engaging section 221 being connected with one end of the horizontal section 220 and extending upward, a tail section 222 being connected with the other end of the horizontal section 220 and horizontally extending away from the side of the horizontal section 220, and a vertical retaining section 223 being located between the tail section 222 and the elastic engaging section 221, being connected with the horizontal section 220 and extending upward.

Referring to FIGS. 4 and 5, the female terminal 22 has a vertical sheet structure. The elastic engaging section 221 is not completely perpendicular to the horizontal section 220, but slightly tilted at an angle so as to being mated with one corresponding male terminal 32 (label seen in FIG. 9). The elastic engaging section 221 has a first protrusion 2210, which is located on the top of the elastic engaging section 221 and protrudes toward the direction opposite to the tail section 222. In the embodiment, the first protrusion 2210 protrudes toward the receiving cavity 204 of the female housing 20. The top of the first protrusion 2210 is a slope 2212 to be used for guiding the corresponding male terminal 32 when mating. A bottom surface 2214 of the first protrusion 2210 is generally perpendicular to the elastic engaging section 221.

Referring to FIGS. 4 and 5, the female terminal 22 further has an arc section 224 to connect the horizontal section 220 and the elastic engaging section 221 for preventing the elastic engaging section 221 from being difficult to offset or being broken when mating.

Referring to FIGS. 4 and 5, the tail section 222 of the female terminal 22 is lower than the horizontal section 220 and horizontally extends outward. The vertical retaining section 223 forms multiple barbs. The length of the elastic engaging section 221 is greater than that of the vertical retaining section 223. The elastic engaging section 221 and the vertical retaining section 223 are independent and separate.

Please refer to FIG. 6, when the female terminal 22 is mounted on the female housing 20, the elastic engaging section 221 is received in the corresponding female terminal-receiving passage 206, and the first protrusion 2210 is partly exposed in the receiving cavity 204 for being engaged with the corresponding male terminal 32. The horizontal section 220 is embedded in the bottom wall 201, and the vertical retaining section 223 is inserted into and fixed by the corresponding female terminal-retaining hole 207. The tail section 222 extends out of the female housing 20 for being connected with an outer circuit board (not shown).

Figure 7:
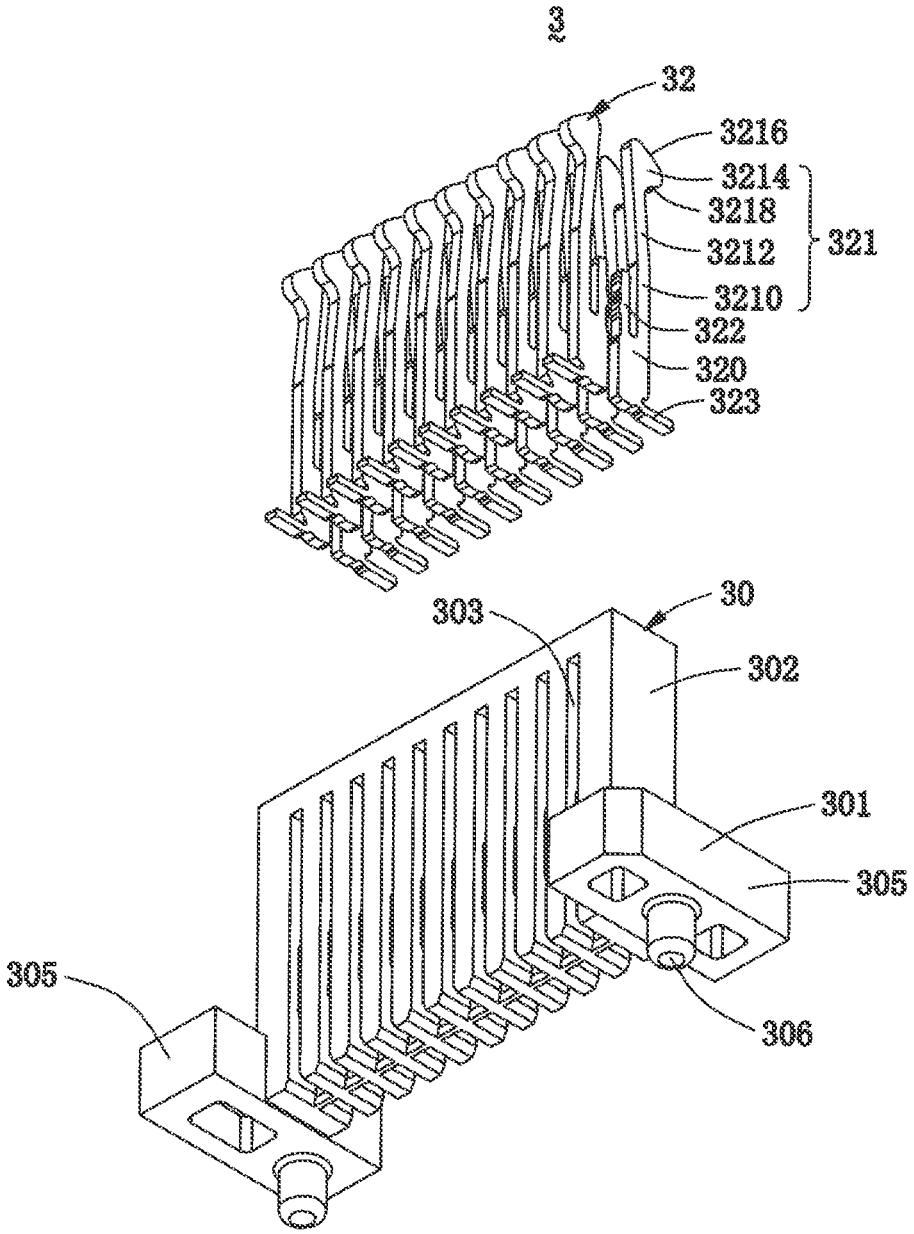
FIG. 7 is an exploded view of a male connector of the present invention.
Figure 8:
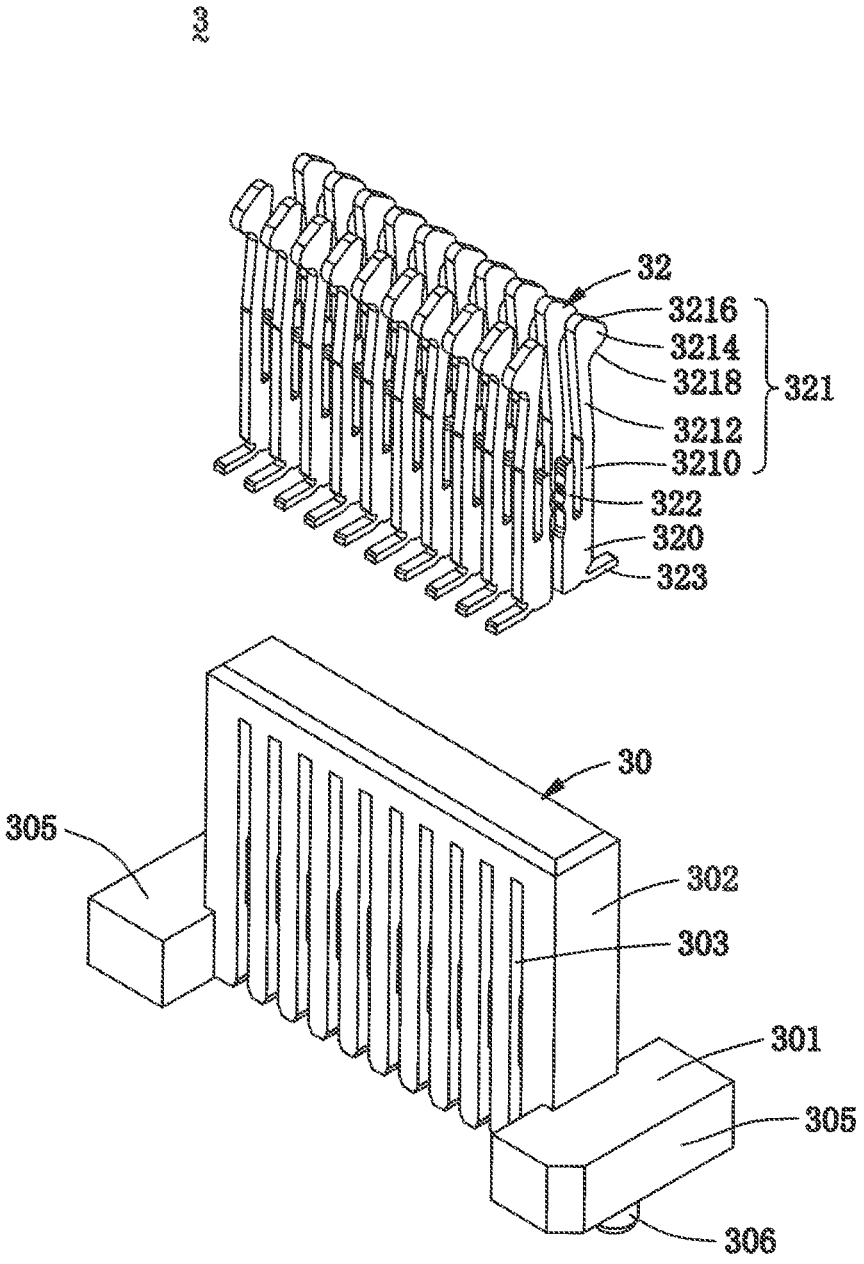
FIG. 8 is an exploded view of the male connector along another direction.
Figure 9:
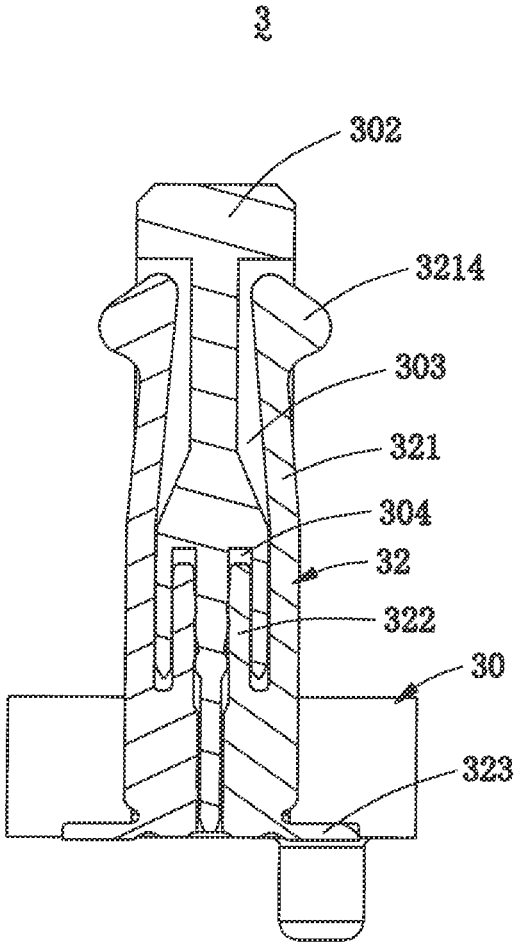
FIG. 9 is a section view of the male connector.

Please refer to FIGS. 7 to 9, the male connector 3 includes a male housing 30 and two rows of symmetrically arranged male terminals 32.

Referring FIGS. 7 and 8, the male housing 30 is elongated and includes a base 301, a tongue plate 302 standing on the base 301, two rows of male terminal-receiving passages 303 being symmetrically formed on the tongue plate 302, and two rows of male terminal-retaining holes 304 (label seen in FIG. 9) being symmetrically formed on the tongue plate 302 and located on the inside of the corresponding male terminal-receiving passages 303. Please refer to FIG. 9, each male terminal-retaining hole 304 is communicated with the corresponding male terminal-receiving passage 303 under the tongue plate 302.

Referring to FIGS. 7 and 8, in the embodiment, the base 301 consists of two support blocks 305 respectively located on two sides of the tongue plate 302. Each support block 305 disposes a support post 306 on the bottom thereof to fix the male connector 3 on the other outer circuit board (not shown). The bottoms of these male terminal-receiving passages 303 pass through the bottom of the tongue plate 302, and the tops of these male terminal-receiving passages 303 do not pass through the top of the tongue plate 302. There is a certain distance between the tops of these male terminal-receiving passages 303 and the top of the tongue plate 302. As shown in FIG. 9, the tongue plate 302 has a T-shaped section.

Referring to FIGS. 7 and 8, each male female 32 has a vertical plate 320, an elastic arm 321 standing on the top of the vertical plate 320, a retaining arm 322 standing on the top of the vertical plate 320 and located on the side of the elastic arm 321, and a tail portion 323 located on the bottom of the vertical plate 320 and horizontally extending away from the side of the vertical plate 320. The length of the elastic arm 321 is greater than that of the retaining arm 322, and the both are independent and separate. The elastic arm 321 has an upright section 3210 connected to the vertical plate 320, a tilted section 3212 extending upward from the top of the upright section 3210 and being tilted to the retaining arm 322, and a second protrusion 3214 being located on the top of the tilted section 3212 and protruding toward the direction same as the tail portion 323. The top of the second protrusion 3214 is an inclined surface 3216 to be used for guiding the corresponding female terminal 22 when mating. A bottom surface 3218 of the second protrusion

3214 is generally perpendicular to the tilted section 3212. The retaining arm 322 forms multiple barbs.

Please refer to FIG. 9, when the male terminal 32 is mounted in the male housing 30, the elastic arm 321 is received in the corresponding male terminal-receiving passage 303, the second protrusion 3214 is partly exposed out of the male terminal-receiving passage 303 for being engaged with the corresponding female terminal 22. The retaining arm 322 is inserted into the corresponding male terminal-retaining hole 304. The tail portion 323 horizontally extends out of the tongue plate 302.

Referring to FIG. 3, when the male connector 3 and the female connector 2 are engaged with each other, the tongue plate 302 of the male connector 3 is inserted into the receiving cavity 204 from the opening 205 of the female connector 2. The second protrusion 3214 slides downward along the slope 2212 of the first protrusion 2210, or specifically the inclined surface 3216 of the second protrusion 3214 slides downward along the slope 2212 of the first protrusion 2210. Gradually, the elastic engaging section 221 of the female terminal 22 moves outward, and the elastic arm 321 of the male terminal 32 moves inward. Finally, the second protrusion 3214 passes the first protrusion 2210, and the bottom surface 3218 of the second protrusion 3214 contacts with the bottom surface 2214 of the first protrusion 2210. Therefore, the second protrusion 3214 and the first protrusion 2210 can form a holding state to further make the male connector 3 and the female connector 2 be engaged with each other.

As described above, the elastic arm 321 and the second protrusion 3214 together construct an elastic mating structure, and the elastic engaging section 221 and the first protrusion 2210 together construct an elastic mating structure. The board to board connector assembly 1 can ensure the reliable connection and the stable electrical contact effect between terminals 22, 32 and further ensure the reliable electrical connection between the two connectors 2, 3 by the elastic mating structures of the male terminals 32 and the female terminals 22.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A board to board connector assembly, comprising:

a female connector including:

a female housing, which has a bottom wall, two longitudinal walls standing on the bottom wall and being parallel to each other, two transverse walls standing on the bottom wall and being parallel to each other, a receiving cavity defined by the two longitudinal walls and the two transverse walls, an opening formed above the receiving cavity, and two rows of female terminal-receiving passages being symmetrically formed on the inside of the longitudinal walls and passing through the opening and the bottom wall; and two rows of symmetrically arranged female terminals, each of which has a horizontal section, an elastic engaging section being connected with one end of the horizontal section and extending upward, and a tail section being connected with the other end of the horizontal section and horizontally extending away from the side of the horizontal section; the elastic engaging section having a first protrusion, which is located on the top of the elastic engaging section and protrudes toward the direction opposite to the tail section; wherein the elastic engaging section is received in the corresponding female terminal-receiving passage, the first protrusion being partly exposed in the receiving cavity, and the tail section extending out of the female housing; and a male connector including:

a male housing, which includes a base, a tongue plate standing on the base, and two rows of male terminal-receiving passages being symmetrically formed on the tongue plate; and two rows of symmetrically arranged male terminals, each of which has a vertical plate, an elastic arm standing on the top of the vertical plate, and a tail portion located on the bottom of the vertical plate and horizontally extending away from the side of the vertical plate; the elastic arm having a second protrusion, which is located on the top of the elastic arm and protrudes toward the direction same as the tail portion; the elastic arm being located in the corresponding male terminal-receiving passage; the second protrusion being partly exposed outside the male terminal-receiving passage for being engaged with the corresponding female terminal; and the tail portion horizontally extending out of the tongue plate;

when the male connector and the female connector are engaged with each other, the tongue plate of the male connector is inserted into the receiving cavity from the opening of the female connector, the second protrusion passes the first protrusion, and a bottom surface of the second protrusion contacts with a bottom surface of the first protrusion to form a holding state.

2. The board to board connector assembly as claimed in claim 1, wherein the top of the first protrusion is a slope, and the bottom surface of the first protrusion is perpendicular to the elastic engaging section; and the top of the second protrusion is an inclined surface, and the bottom surface of the second protrusion is perpendicular to the elastic arm.

3. The board to board connector assembly as claimed in claim 1, wherein the female terminal further has a vertical retaining section being located between the tail section and the elastic engaging section, being connected with the horizontal section and extending upward; the length of the elastic engaging section is greater than that of the vertical retaining section; the elastic engaging section and the vertical retaining section are independent and separate; the elastic engaging section is not completely perpendicular to the horizontal section; and the female housing further has two rows of symmetrically arranged female terminal-retaining holes formed on the bottom wall and respectively located on two sides of the two longitudinal walls, and each female terminal-retaining hole is communicated with one corresponding female terminal-receiving passage on the bottom of the bottom wall;

wherein the vertical retaining section is inserted into and fixed into the corresponding female terminal-retaining hole.

4. The board to board connector assembly as claimed in claim 1, wherein the female terminal further has an arc section to connect the horizontal section and the elastic engaging section.

5. The board to board connector assembly as claimed in claim 1, wherein the male terminal further has a retaining arm standing on the top of the vertical plate and located on the side of the elastic arm; the length of the elastic arm is greater than that of the retaining arm, and the elastic arm and the retaining arm are independent and separate; and the male housing further includes two rows of male terminal-retaining holes being symmetrically formed on the tongue plate and located on the inside of the corresponding male terminal-receiving passages; each male terminal-retaining hole is communicated with the corresponding male terminal-receiving passage under the tongue plate;

wherein the retaining arm is inserted into and fixed into the corresponding male terminal-retaining hole.

6. The board to board connector assembly as claimed in claim 1, wherein the elastic arm further has an upright section connected to the top of the vertical plate, and a tilted section extending upward from the top of the upright section and being tilted to the retaining arm; the second protrusion is formed on the top of the tilted section, and the bottom surface of the second protrusion is perpendicular to the tilted section.

7. The board to board connector assembly as claimed in claim 1, wherein the tongue plate has a T-shaped section, the bottoms of these male terminal-receiving passages pass through the bottom of the tongue plate, and the tops of these male terminal-receiving passages do not pass through the top of the tongue plate.

8. The board to board connector assembly as claimed in claim 1, wherein the male housing and the female housing are elongated;

the two longitudinal walls and the two transverse walls of the female housing are perpendicular to each other; the longitudinal wall is longer than the transverse wall; and the opening defined by the two longitudinal walls and the two transverse walls is rectangular; and the base of the male housing consists of two support blocks respectively located on two sides of the tongue plate, and each support block disposes a support post on the bottom thereof.

9. A male connector, comprising:

a male housing, which includes a base, a tongue plate standing on the base, two rows of male terminal-receiving passages being symmetrically formed on the tongue plate, and two rows of male terminal-retaining holes being symmetrically formed on the tongue plate and located on the inside of the corresponding male terminal-receiving passages; the tongue plate having a T-shaped section; and each male terminal-retaining hole being communicated with the corresponding male terminal-receiving passage under the tongue plate; and two rows of symmetrically arranged male terminals, each of which has a vertical plate, an elastic arm standing on the top of the vertical plate, and a tail portion located on the bottom of the vertical plate and horizontally extending away from the side of the vertical plate; the elastic arm having an upright section connected to the top of the vertical plate, a tilted section extending upward from the top of the upright section and being tilted to the retaining arm, and a second protrusion, which is located on the top of the tilted section and protrudes toward the direction same as the tail portion; the top of the second protrusion is an inclined surface;

wherein the elastic arm is located in the corresponding male terminal-receiving passage, the second protrusion being partly exposed outside the male terminal-receiving passage for being engaged with a corresponding female terminal, the retaining arm being inserted into and fixed into the corresponding male terminal-retaining hole, and the tail portion horizontally extending out of the tongue plate.

* * * * *